US010099899B2

(12) United States Patent
Smith

(10) Patent No.: US 10,099,899 B2
(45) Date of Patent: Oct. 16, 2018

(54) SHAKE-PROOF HOOK

(71) Applicant: S&C Electric Company, Chicago, IL (US)

(72) Inventor: Richard George Smith, North Aurora, IL (US)

(73) Assignee: S&C Electric Company, Chicago, IL (US)

( * ) Notice: Subject to any disclaimer, the term of this patent is extended or adjusted under 35 U.S.C. 154(b) by 17 days.

(21) Appl. No.: 15/347,240

(22) Filed: Nov. 9, 2016

(65) Prior Publication Data

US 2017/0129746 A1 May 11, 2017

Related U.S. Application Data

(60) Provisional application No. 62/253,895, filed on Nov. 11, 2015.

(51) Int. Cl.
*B66C 1/34* (2006.01)

(52) U.S. Cl.
CPC ..... *B66C 1/34* (2013.01)

(58) Field of Classification Search
CPC ..... B66C 1/34
USPC ..... 294/82.1, 82.13, 82.14, 82.17, 82.11, 294/82.23; 24/598.8, 598.9, 599.8, 600.7; 59/93
See application file for complete search history.

(56) References Cited

U.S. PATENT DOCUMENTS 1,305,135 A * 5/1919 Loney ..... B66C 1/36 24/698.1
1,482,826 A * 2/1924 Stolstedt ..... F16B 45/02 24/598.9
1,522,979 A * 1/1925 Ratigan ..... E21B 19/04 24/600.7
1,798,001 A * 3/1931 Seckler ..... E21B 19/04 248/304
2,333,925 A * 11/1943 Grossett ..... B22D 31/00 24/598.4
3,132,395 A * 5/1964 Luketa ..... F16G 17/00 24/598.8
D241,118 S 8/1976 Schreyer et al.
4,139,228 A * 2/1979 Varadi ..... B66C 1/663 294/81.53
4,148,514 A * 4/1979 McCullough ..... B66C 1/34 294/82.34
D271,465 S 11/1983 Boissonnet
D272,717 S 2/1984 Faidide
4,712,646 A 12/1987 Page
D297,878 S 9/1988 Bergstrom
5,002,420 A * 3/1991 Loyd ..... B66C 1/36 294/82.1
D337,935 S 8/1993 Hawley
(Continued)

*Primary Examiner* — Paul T Chin
(74) *Attorney, Agent, or Firm* — Lorenz & Kopf, LLP

(57) ABSTRACT

A shake-proof hook is provided, which includes a hook end that defines a receptacle. The hook end includes a lead-in portion and a channel spaced apart from the lead-in portion. The shake-proof hook includes a coupling end coupled to the hook end. The coupling end includes a retaining portion and at least one coupling ring. The retaining portion extends along a first axis transverse to a longitudinal axis of the shake-proof hook and the at least one coupling ring extends along a second axis. The second axis is transverse to the longitudinal axis and the second axis is different than the first axis.

18 Claims, 9 Drawing Sheets

(56) References Cited

U.S. PATENT DOCUMENTS

| | | | |
|---|---|---|---|
| 5,257,441 | A | 11/1993 | Barlow |
| 5,292,165 | A | 3/1994 | Wiklund |
| 5,538,303 | A | 7/1996 | Dunham |
| D399,127 | S | 10/1998 | Messer |
| 5,884,950 | A | 3/1999 | Fredriksson |
| D431,650 | S | 10/2000 | Guala et al. |
| 6,283,524 | B1 | 9/2001 | Simond |
| D449,975 | S | 11/2001 | Smith et al. |
| D455,642 | S | 4/2002 | Kelleghan |
| D466,791 | S | 12/2002 | Kelleghan |
| D468,997 | S | 1/2003 | Chang |
| D485,431 | S | 1/2004 | Hsu |
| D496,256 | S | 9/2004 | Hong |
| D521,362 | S | 5/2006 | Kelleghan |
| D551,788 | S | 9/2007 | Bao |
| D569,718 | S | 5/2008 | Nakamura et al. |
| D573,875 | S | 7/2008 | Anderson |
| 7,437,806 | B2 | 10/2008 | Lin |
| D595,119 | S | 6/2009 | Kelleghan |
| D601,410 | S | 10/2009 | Lee |
| 8,015,676 | B1 | 9/2011 | Choate |
| D657,660 | S | 4/2012 | Petty et al. |
| D659,518 | S | 5/2012 | Xu |
| 8,276,247 | B2 | 10/2012 | Yang |
| D670,555 | S | 11/2012 | Lin |
| D671,293 | S | 11/2012 | Fredriksson |
| 8,572,819 | B2 | 11/2013 | Yang |
| D699,098 | S | 2/2014 | Fretz |
| D708,931 | S | 7/2014 | Petzl |
| 9,003,617 | B2 | 4/2015 | Walker et al. |
| D730,159 | S | 5/2015 | Grimm et al. |
| D730,722 | S | 6/2015 | Grimm et al. |
| D735,018 | S | 7/2015 | McEvilly |
| 9,091,295 | B1 | 7/2015 | Yang et al. |
| D738,196 | S | 9/2015 | Petzl |
| D743,778 | S | 11/2015 | Huang |
| 9,175,717 | B2 | 11/2015 | Tardif |
| D745,377 | S | 12/2015 | Ressler et al. |
| 9,249,602 | B1 | 2/2016 | Greer |
| 9,322,428 | B2 | 4/2016 | Pemer |
| D755,612 | S | 5/2016 | Cooper |
| D758,172 | S | 6/2016 | Hung |
| D762,107 | S | 7/2016 | French |
| D766,707 | S | 9/2016 | Greenleaf |
| D770,886 | S | 11/2016 | Whitaker |
| D779,931 | S | 2/2017 | Mondragon et al. |
| D796,941 | S * | 9/2017 | Smith ..... D8/367 |
| 2008/0116706 | A1 * | 5/2008 | Hung ..... B66C 1/34 294/131 |

* cited by examiner

SHAKE-PROOF HOOK

CROSS-REFERENCE TO RELATED APPLICATION

This application claims the benefit of U.S. Provisional Application No. 62/253,895, filed on Nov. 11, 2015. The relevant disclosure of the above application is incorporated herein by reference.

TECHNICAL FIELD

The present disclosure generally relates to power distribution systems, and more particularly relates to a shake-proof hook for use in opening a fuse associated with a power distribution system.

BACKGROUND

Electrical equipment such as electrical switchgear used in electric power distribution systems generally include one or more fuses to interrupt the electric circuit for servicing. In certain applications, such as underground and pad-mounted applications, the fuses may be mounted within an electrical housing or box and may require an application of a force to open the fuse. In addition, in some instances the fuse may move unexpectedly during opening, which may interfere with the movement of the fuse to the opened position.

Accordingly, it is desirable to provide a hook for applying a force to open a fuse, which is shake-proof or resistant to unexpected movement of the fuse during opening to enable the controlled application of an opening force. Furthermore, other desirable features and characteristics of the present invention will become apparent from the subsequent detailed description and the appended claims, taken in conjunction with the accompanying drawings and the foregoing technical field and background.

SUMMARY

According to various embodiments, a shake-proof hook is provided. In one example, the shake-proof hook includes a hook end that defines a receptacle. The hook end includes a lead-in portion and a channel spaced apart from the lead-in portion. The shake-proof hook also includes a coupling end coupled to the hook end. The coupling end includes a retaining portion and at least one coupling ring. The retaining portion extends along a first axis transverse to a longitudinal axis of the shake-proof hook and the at least one coupling ring extends along a second axis. The second axis is transverse to the longitudinal axis and the second axis is different than the first axis.

Also provided is a shake-proof hook. The shake-proof hook includes a hook end that defines a receptacle. The hook end includes a first arm spaced apart from a second arm via a branch. The branch defines a channel to receive a portion of a fuse. The shake-proof hook includes a coupling end coupled to the hook end by the first arm. The coupling end includes a retaining portion, a first coupling ring and a second coupling ring extending outwardly from a base. The retaining portion extends along a first axis transverse to a longitudinal axis of the shake-proof hook, and the first coupling ring and the second coupling ring extend along a second axis. The second axis is transverse to the longitudinal axis and the second axis is different than the first axis.

Further provided is a shake-proof hook. The shake-proof hook includes a hook end that defines a receptacle. The hook end includes a first arm spaced apart from a second arm via a branch. The branch defines a channel to receive a portion of a fuse. The shake-proof hook includes a coupling end coupled to the hook end by the first arm. The coupling end includes a retaining portion, a first coupling ring and a second coupling ring extending outwardly from a base. The retaining portion extends along a first axis transverse to a longitudinal axis of the shake-proof hook and the retaining portion is spaced apart from the second arm by a distance. The first coupling ring and the second coupling ring extend outwardly from opposite sides of the base along a second axis. The second axis is substantially perpendicular to the longitudinal axis and the second axis is different than the first axis.

DESCRIPTION OF THE DRAWINGS

The exemplary embodiments will hereinafter be described in conjunction with the following drawing figures, wherein like numerals denote like elements, and wherein.

DETAILED DESCRIPTION

Figure 1:
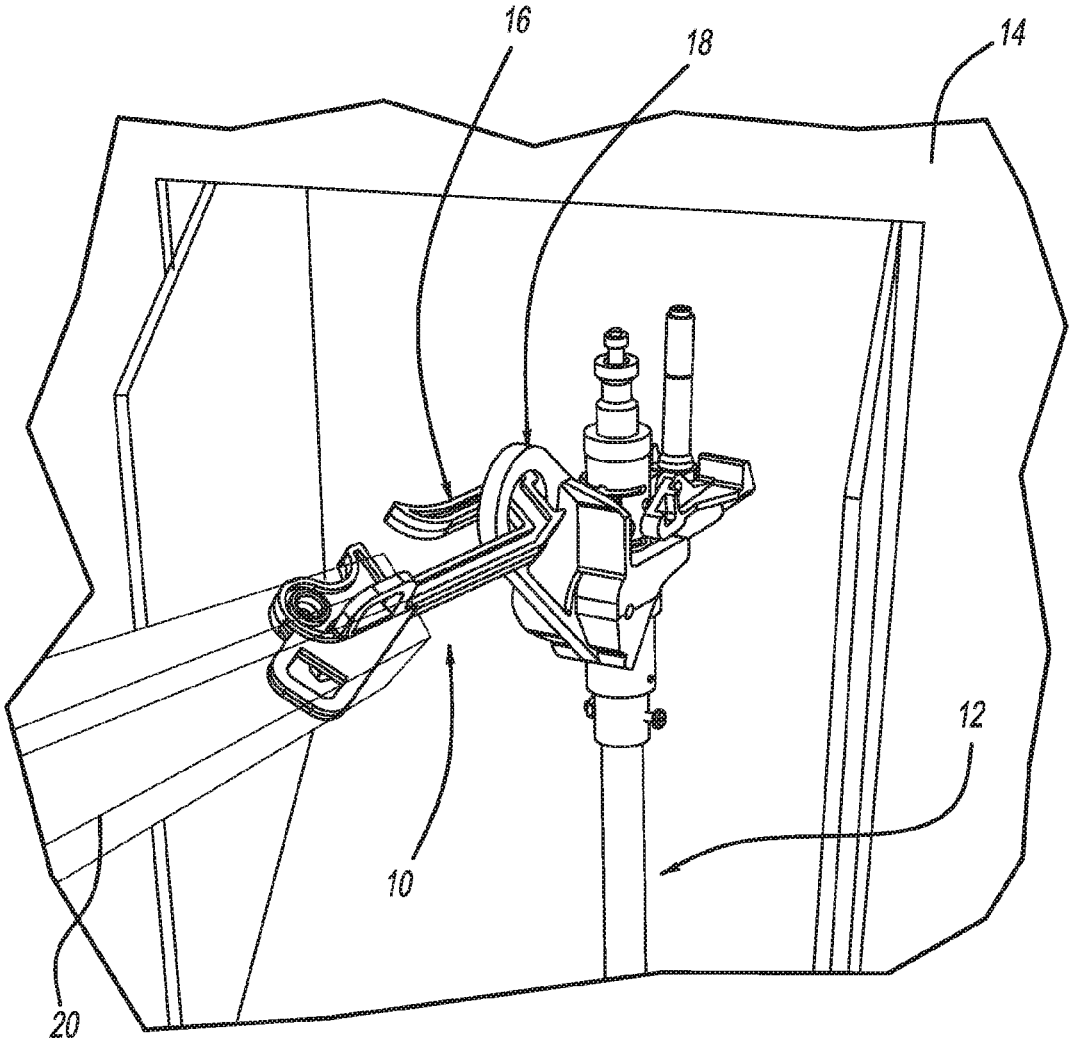
FIG. 1 is an environmental schematic illustration of a shake-proof hook for use with a fuse of a power distribution system in accordance with the present disclosure, in which the fuse is in a first, closed position.

The following detailed description is merely exemplary in nature and is not intended to limit the application and uses. Furthermore, there is no intention to be bound by any expressed or implied theory presented in the preceding technical field, background, brief summary or the following detailed description. In addition, those skilled in the art will appreciate that embodiments of the present disclosure may be practiced in conjunction with any system that requires a hook to apply a force for opening a device, and that the application of the shake-proof hook to a fuse of a power distribution system described herein is merely one exemplary embodiment according to the present disclosure. Further, it should be noted that many alternative or additional functional relationships or physical connections may be present in an embodiment of the present disclosure. In addition, while the figures shown herein depict an example with certain arrangements of elements, additional intervening elements, devices, features, or components may be present in an actual embodiment. It should also be understood that the drawings are merely illustrative and may not be drawn to scale.

In addition, the connecting lines shown in the various figures contained herein are intended to represent example functional relationships and/or physical couplings between the various elements. It should be noted that many alternative or additional functional relationships or physical connections may be present in an embodiment of the present disclosure.

A shake-proof hook is provided according to various embodiments. In one embodiment, the shake-proof hook includes a hook end that defines a receptacle. The hook end includes a lead-in portion and a channel spaced apart from the lead-in portion. The shake-proof hook includes a coupling end coupled to the hook end. The coupling end includes a retaining portion and at least one coupling ring. The retaining portion extends along a first axis transverse to a longitudinal axis of the shake-proof hook and the at least one coupling ring extends along a second axis. The second axis is transverse to the longitudinal axis and the second axis is different than the first axis.

Also provided is a shake-proof hook. The shake-proof hook includes a hook end that defines a receptacle. The hook end includes a first arm spaced apart from a second arm via a branch, and the branch defines a channel to receive a portion of a fuse. The shake-proof hook includes a coupling end coupled to the hook end by the first arm. The coupling end includes a retaining portion, a first coupling ring and a second coupling ring extending outwardly from a base. The retaining portion extends along a first axis transverse to a longitudinal axis of the shake-proof hook, and the first coupling ring and the second coupling ring extend along a second axis. The second axis is transverse to the longitudinal axis and the second axis is different than the first axis.

Further provided is a shake-proof hook. The shake-proof hook includes a hook end that defines a receptacle. The hook end includes a first arm spaced apart from a second arm via a branch, and the branch defines a channel to receive a portion of a fuse. The shake-proof hook includes a coupling end coupled to the hook end by the first arm. The coupling end includes a retaining portion, a first coupling ring and a second coupling ring extending outwardly from a base. The retaining portion extends along a first axis transverse to a longitudinal axis of the shake-proof hook and the retaining portion is spaced apart from the second arm by a distance. The first coupling ring and the second coupling ring extend outwardly from opposite sides of the base along a second axis. The second axis is substantially perpendicular to the longitudinal axis and the second axis is different than the first axis.

With reference to FIG. 1, a shake-proof hook 10 is shown. In one example, the shake-proof hook 10 is employed to open a fuse 12 associated with a power distribution system 14. In this example, the power distribution system 14 comprises a Pad Mount Heavy Duty (PMH) pad mounted distribution system, however, the shake-proof hook 10 may be employed to open a fuse associated with any other suitable power distribution system, such as a Pad Mount Elbow (PME) pad mounted distribution system. It should be noted that only a portion of the power distribution system 14 is illustrated in FIG. 1 for clarity and understanding.

In the example of FIG. 1, the fuse 12 includes a ring 16. The ring 16 is movable to interrupt an electric circuit associated with the power distribution system 14. The ring 16 defines an opening 18. Generally, the opening 18 is circular, however, the opening 18 may have any desired shape. As illustrated in FIG. 1, the shake-proof hook 10 is positionable within the opening 18 via a conventional shotgun stick 20, for example. It should be noted that the use of the shotgun stick 20 is merely exemplary, as any suitable device may be employed to position or couple the shake-proof hook 10 to the ring 16 of the fuse 12. For example, a grappler tool or one or more handling tools commercially available from S&C Electric Company of Chicago, Ill., may also be used to position the shake-proof hook 10.

Figure 2:
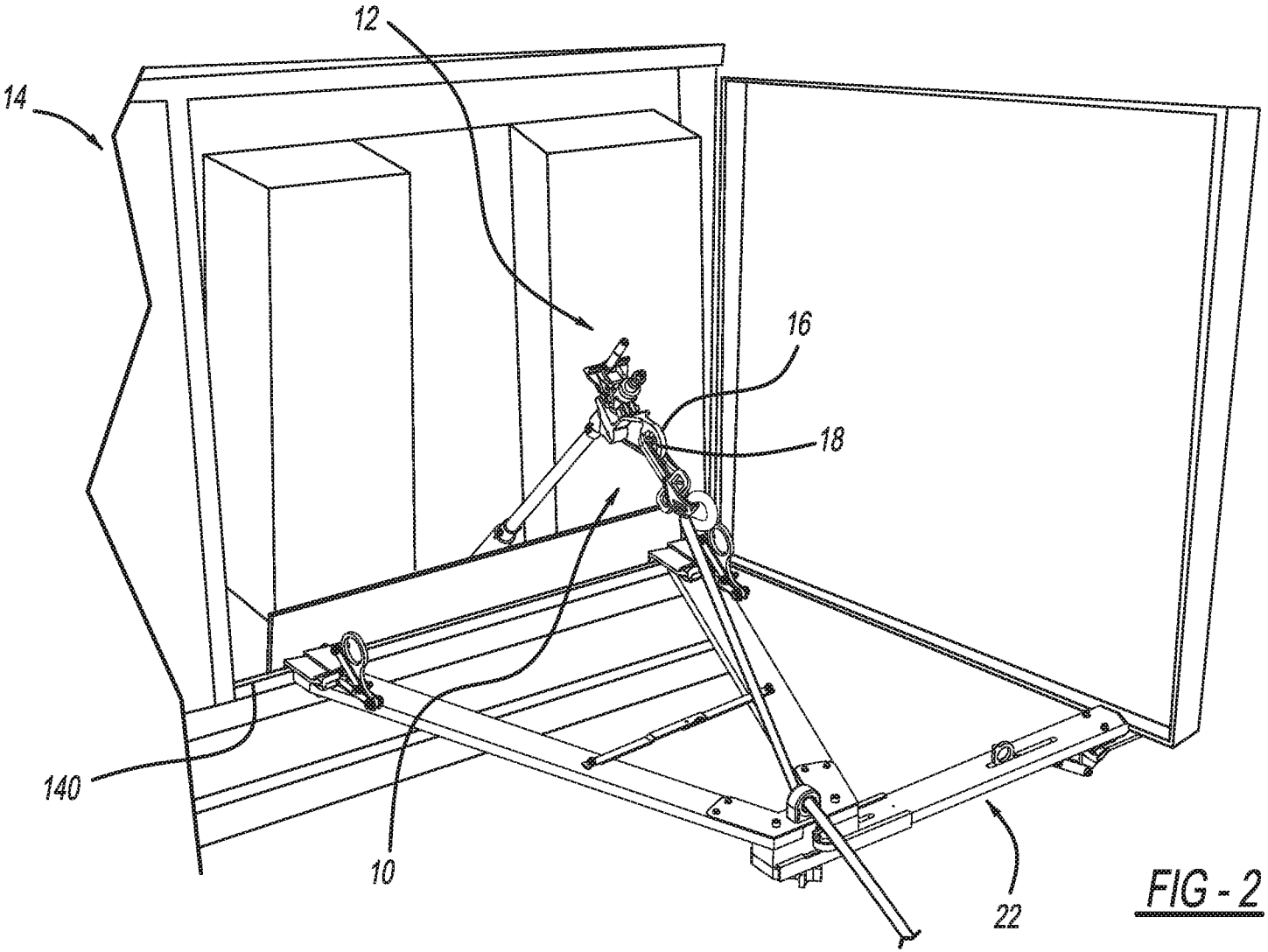
FIG. 2 is an environmental schematic illustration of the shake-proof hook of FIG. 1 being used to move the fuse to a second, open position.

With reference to FIG. 2, the shake-proof hook 10 is shown fully coupled to the ring 16 of the fuse 12. In this position, the shake-proof hook 10 may be coupled to a rig 22 and used to move the fuse 12 from a first, closed position (FIG. 1) to a second, open position (FIG. 2). As the shake-proof hook 10 is securely coupled to the ring 16, any unexpected movement of the fuse 12 while moving between the first position and the second position does not interfere with the connection between the shake-proof hook 10 and the ring 16, thereby ensuring that an operator has control of the fuse 12 during the movement of the fuse between the first position and the second position. This improves the operator's ability to affect the movement of the fuse 12 between the first position and the second position. It should be noted that the shake-proof hook 10 need not be coupled to the rig 22 to move the fuse 12 between the first position and the second position. Rather, the shake-proof hook 10 may be coupled to any suitable device or apparatus for moving the fuse 12. As the rig 22 is outside of the scope of this present disclosure, further details regarding the rig 22 may be found in U.S. Application Ser. No. 62/253,925, filed on Nov. 11, 2015, which was converted into non-provisional U.S. application Ser. No. 15/347,256, filed on Nov. 9, 2016 and published as US 2017/0133187 A1 on May 5, 2017 the relevant content of which is incorporated herein by reference.

Figure 3:
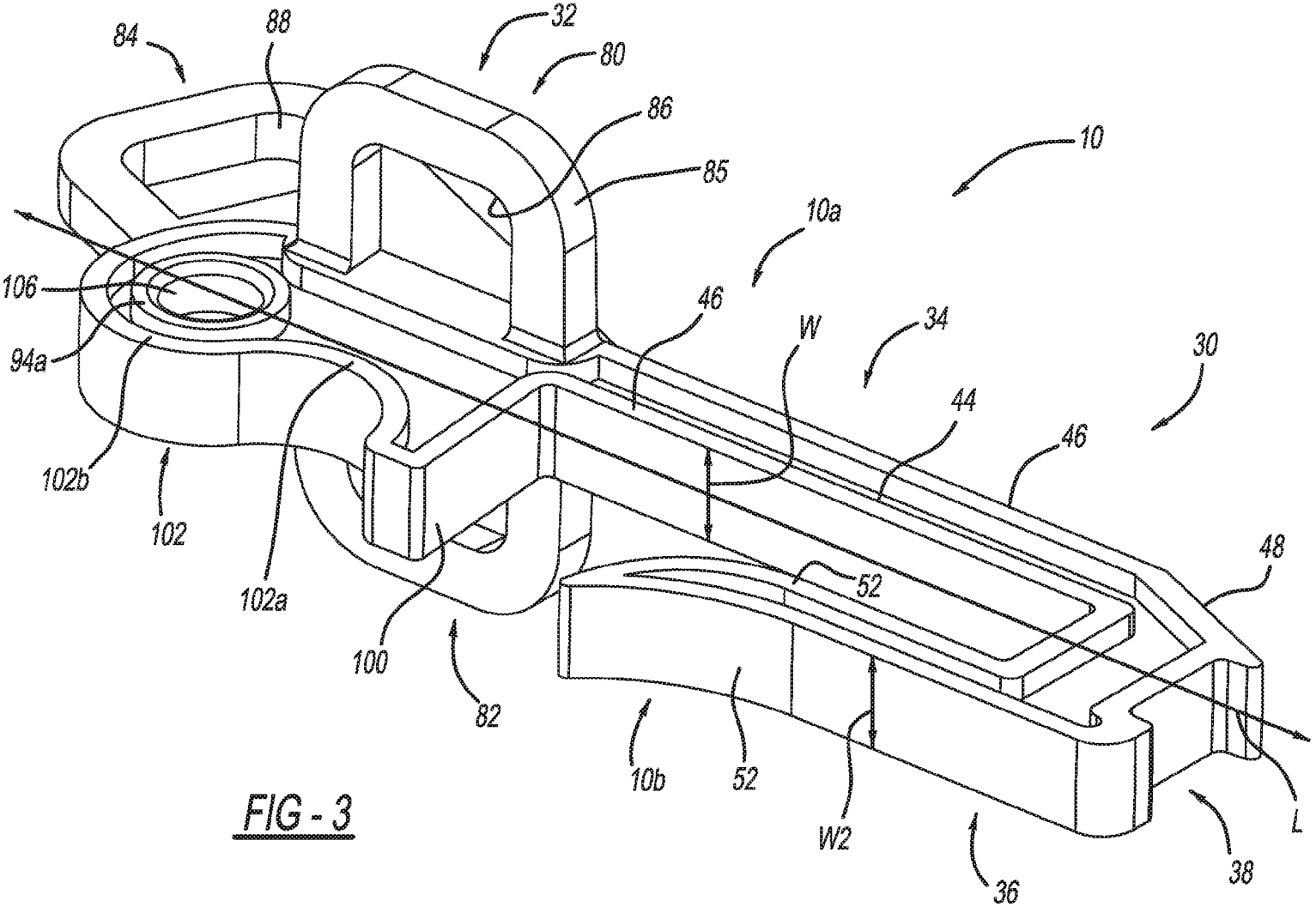
FIG. 3 is a front perspective view of the shake-proof hook of FIG. 1.

With reference to FIG. 3, the shake-proof hook 10 is shown in more detail. As discussed above, the shake-proof hook 10 may be coupled to the ring 16 of the fuse 12 to move the fuse 12 between the first position and the second position. In one example, the shake-proof hook 10 is a monolithic or one-piece component, which is composed of an electrical insulating material, such as a polymer. In one example, the shake-proof hook 10 comprises an RTP 301 polycarbonate with glass fiber, available from RTP Company of Winona, Minn. USA. In this example, the glass fiber may comprise about 10 percent. It should be noted, however, that the shake-proof hook 10 may be composed of any suitable insulating material, and the use of a polycarbonate is merely an example. Moreover, the shake-proof hook 10 may be composed of a suitable insulating material that has a sufficient strength to enable the shake-proof hook 10 to hold a desired amount of weight. In this example, the shake-proof hook 10 may hold up to about 300 pounds (lb.). The shake-proof hook 10 may be formed through any suitable manufacturing technique, such as injection molding, etc. In this example, with additional reference to FIG. 4, the shake-proof hook 10 is substantially symmetric with respect to a longitudinal axis L of the shake-proof hook 10 such that a first side 10*a* of the shake-proof hook 10 is a mirror image of a second side 10*b* of the shake-proof hook 10. It should be understood, however, that one or more portions of the shake-proof hook 10 may be offset or asymmetrical relative to the longitudinal axis L. Generally, the shake-proof hook 10 includes a first, hook end or portion 30 and a second, coupling end or portion 32.

The hook portion 30 couples the shake-proof hook 10 to the ring 16 of the fuse 12 (FIGS. 1 and 2). In one example, the hook portion 30 is substantially U-shaped, however, the hook portion 30 may have any desired shape. In this example, the hook portion 30 includes a first arm 34, a second arm 36 and a branch 38, which interconnects the first arm 34 and the second arm 36.

Figure 4:
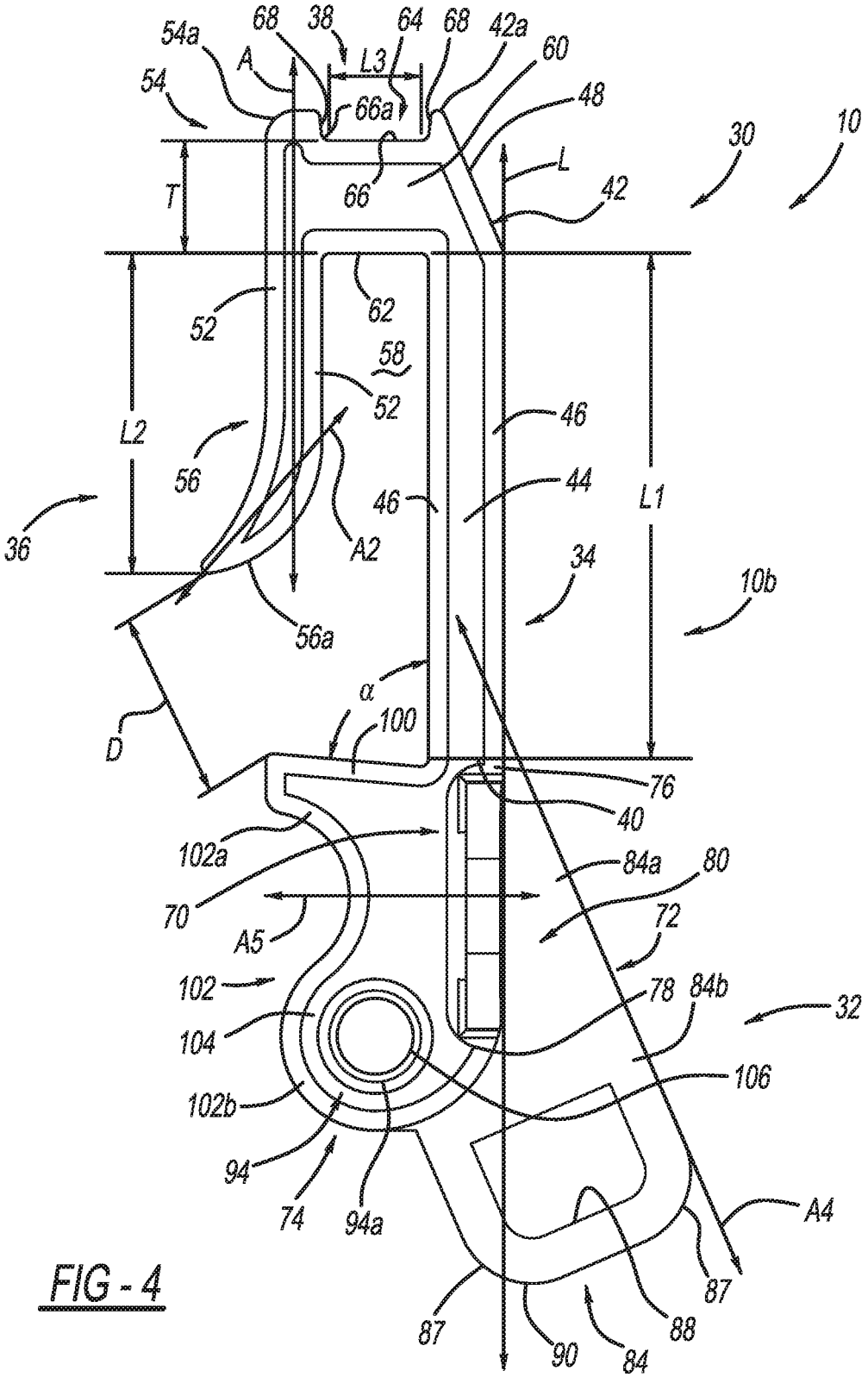
FIG. 4 is a side view of the shake-proof hook of FIG. 1.

The first arm 34 couples the hook portion 30 to the coupling portion 32. With reference to FIG. 4, the first arm 34 extends along the longitudinal axis L of the shake-proof hook 10. It should be noted that FIG. 4 illustrates the side 10*b* of the shake-proof hook 10. As the shake-proof hook 10 is substantially symmetric with respect to the longitudinal axis L, it will be understood that the side 10*a* of the shake-proof hook 10, which is opposite the side 10*b* illustrated in FIG. 4, is a mirror image of the side 10*b* illustrated in FIG. 4. Thus, it will be understood that the following description of the side 10*b* illustrated in FIG. 4 is applicable to the side 10*a* of the shake-proof hook 10.

The first arm 34 has a length L1, which is greater than a length L2 of the second arm 36. The length L1 of the first arm 34 is generally sized to provide a voltage isolation length between the branch 38 and the coupling portion 32. The first arm 34 may also define a channel 44 between opposing sidewalls 46; however, it will be understood that the first arm 34 may have a planar surface, if desired. The sidewalls 46 are generally planar and extend for a width W of the first arm 34 (FIG. 3). The first arm 34 includes a first end 40 and a second end 42. The first end 40 is coupled to the coupling portion 32, and the second end 42 is coupled to the branch 38. In one example, the second end 42 includes a sloped surface 48 and a radius 42*a*. The sloped surface 48 provides a clearance for maneuvering the shake-proof hook 10 near the fuse 12, and the radius 42*a* provides a transition for coupling the second end 42 to the branch 38.

With continued reference to FIG. 4, the second arm 36 is spaced apart from the first arm 34 via the branch 38. The second arm 36 is cantilevered relative to the branch 38 to enable the shake-proof hook 10 to be coupled to the fuse 12. Generally, the second arm 36 passes through the opening 18 of the ring 16 to couple the shake-proof hook 10 to the fuse 12 (FIGS. 1 and 2). In this example, the second arm 36 generally extends along an axis A, which is offset from and substantially parallel to the longitudinal axis L. The second arm 36, similar to the first arm 34, may define a channel 50 between opposing sidewalls 52; however, it will be understood that the second arm 36 may have a planar surface, if desired. The sidewalls 52 are generally planar and extend for a width W2 of the second arm 36 (FIG. 3). The second arm 36 includes a third end 54 and a fourth end 56. The third end 54 is coupled to the branch 38. The third end 54 includes a radius 54*a*, which provides a transition for coupling to the branch 38. The fourth end 56 includes a tip portion with a radius or a lead-in portion 56*a* to assist in guiding the shake-proof hook 10 through the opening 18 of the ring 16 (FIGS. 1 and 2). Generally, the lead-in portion 56*a* extends along an axis A2, which is transverse to the axis A. The second arm 36 extends for the length L2, which is shorter than the length L1, such that the lead-in portion 56*a* is spaced apart from the coupling portion 32 by a distance D. The distance D is selected to enable the ring 16 to be received between the second arm 36 and the first arm 34. Thus, the distance D may be slightly larger than a diameter of the ring 16.

The branch 38 interconnects the first arm 34 and the second arm 36. Generally, the branch 38 interconnects the first arm 34 and the second arm 36 so as to define a receptacle 58 for the ring 16 of the fuse 12. The branch 38 may define a channel 60 between opposing sidewalls 62, 64. The channel 60 may be interconnected with the channels 44 and 50 to provide a uniform appearance for the shake-proof hook 10. The sidewall 62 may be planar, while the opposing sidewall 64 may define a sidewall channel 66. The sidewall channel 66 may be defined such that a thickness T of the branch 38 is slightly less than a diameter of the opening 18 of the ring 16 of the fuse 12 (FIGS. 1 and 2). By sizing the thickness T of the branch 38 to be slightly less than the diameter of the opening 18, the ring 16 may be retained on the shake-proof hook 10 in a shake-proof or movement-resistant fashion. A length L3 of the sidewall channel 66 may also be defined as slightly more than a thickness of the ring 16 such that an entirety of a thickness of the ring 16 may be received within the sidewall channel 66. Thus, walls 68 of the sidewall 64 also aid in coupling and retaining the ring 16 on the shake-proof hook 10. Each of the walls 68 may be coupled to the sidewall channel 66 via a radius 66*a* to facilitate the removal of the shake-proof hook 10 from the ring 16 upon completion of the movement of the fuse 12.

Figure 5:
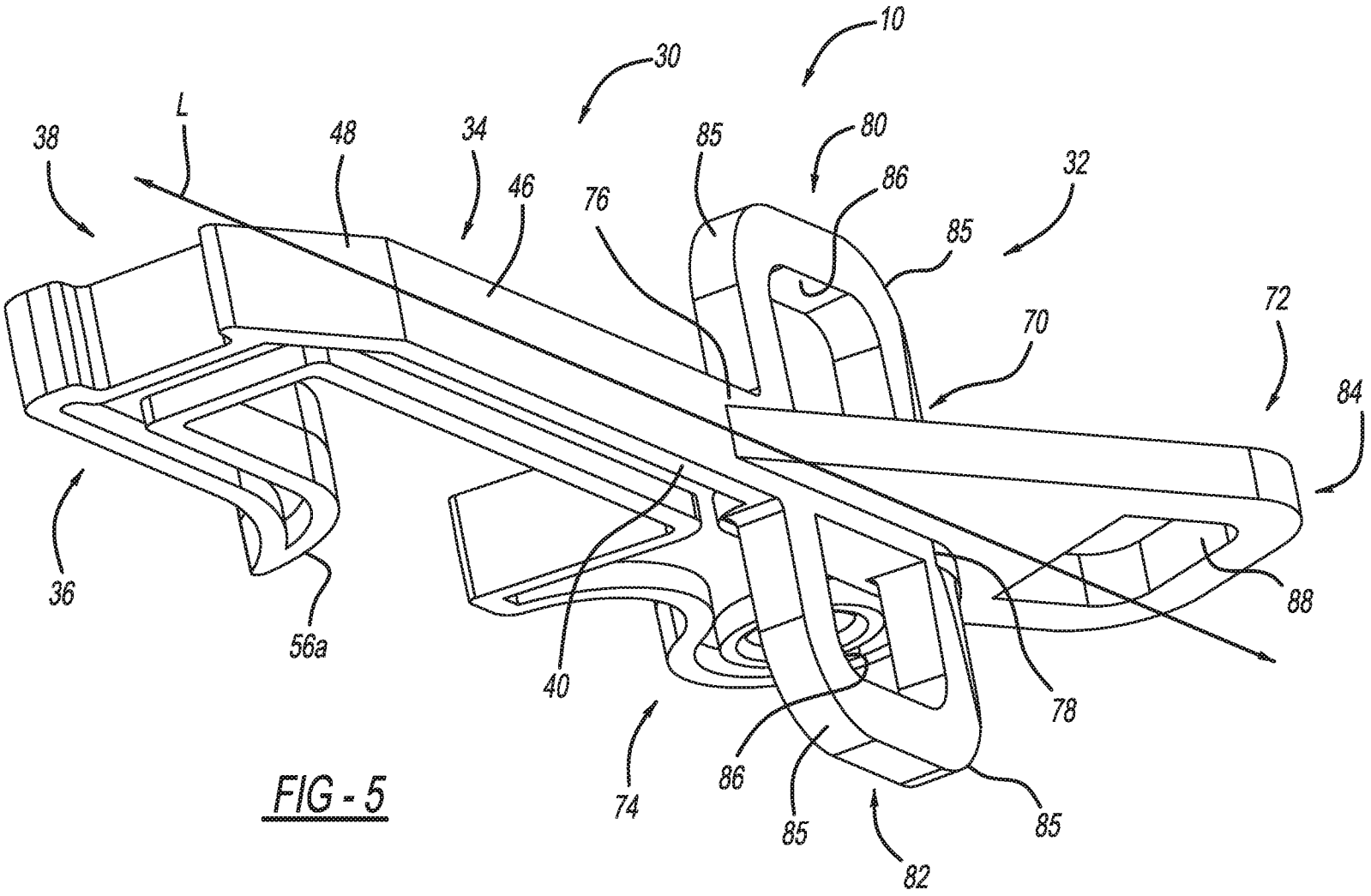
FIG. 5 is a rear perspective view of the shake-proof hook of FIG. 1.
Figure 6:
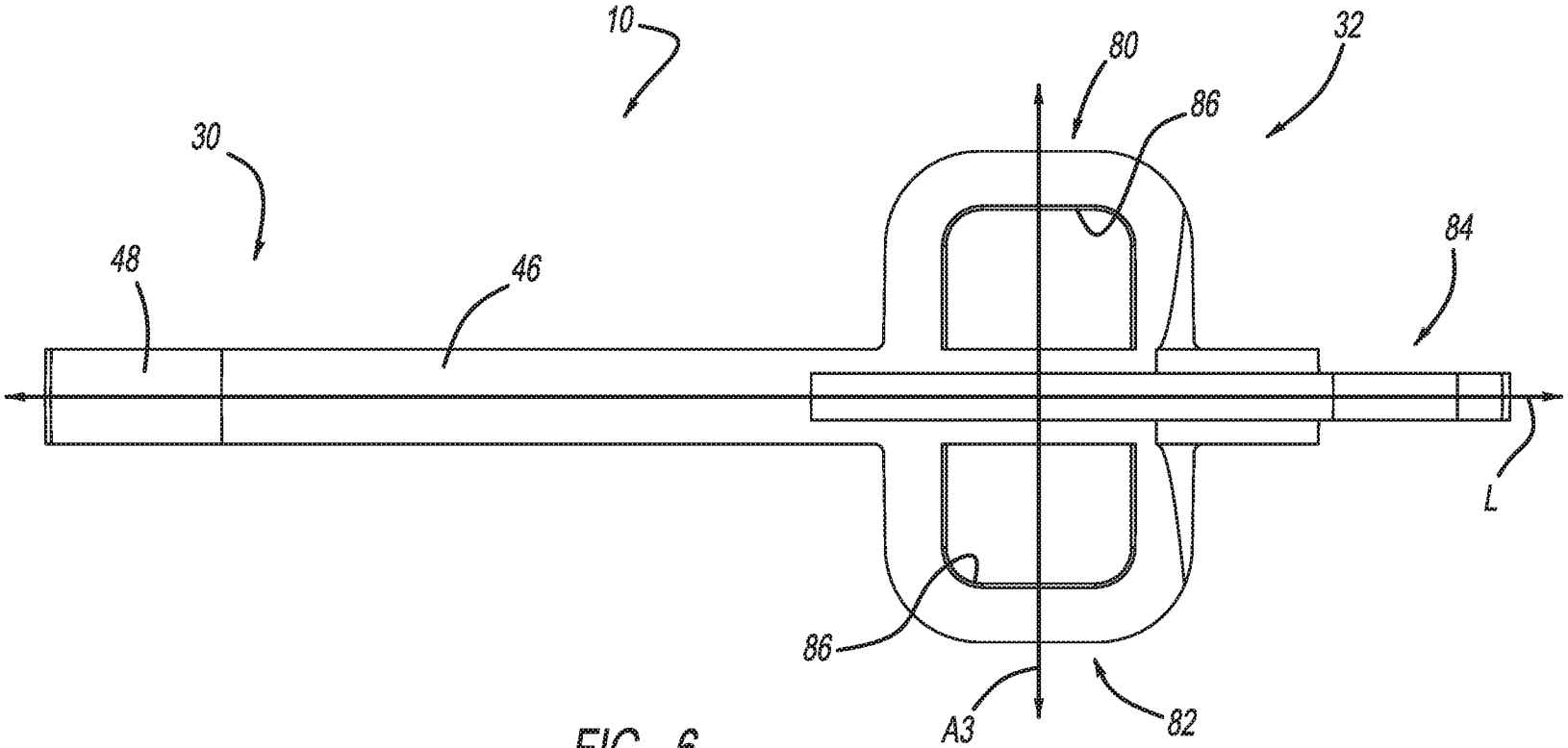
FIG. 6 is a bottom view of the shake-proof hook of FIG. 1.

The coupling portion 32 provides a grasping portion for manipulating the shake-proof hook 10 to couple the shake-proof hook 10 to the ring 16 of the fuse 12 (FIGS. 1 and 2). Generally, the coupling portion 32 includes a base 70. One or more coupling rings 72 and a retaining portion or a rope retaining portion 74 extend outwardly from the base 70. The base 70 extends generally along the longitudinal axis L. With reference to FIG. 5, the base 70 is substantially planar. The base 70 includes a fifth end 76 and a sixth end 78. The fifth end 76 is coupled to the first end 40 of the first arm 34, and the sixth end 78 is coupled to the rope retaining portion 74. In one example, the coupling portion 32 includes a first coupling ring 80, a second coupling ring 82, a third coupling ring 84 and the rope retaining portion 74 of which are each coupled to the base 70.

The first coupling ring 80 and the second coupling ring 82 each extend outwardly from opposite sides of the base 70 along an axis A3. Generally, the first coupling ring 80 and the second coupling ring 82 extend from the base 70 along the axis A3 so as to be transverse to the longitudinal axis L. In one example, the first coupling ring 80 and the second coupling ring 82 extend outwardly from the base 70 along the axis A3 so as to be substantially perpendicular to the longitudinal axis L. In this example, the first coupling ring 80 and the second coupling ring 82 each form or define a coupling bore 86. The coupling bores 86 are substantially D-shaped; however, the coupling bores 86 may have any desired shape, such as rectangular, square, circular, oval, etc. The coupling bores 86 are sized to couple the shake-proof hook 10 to a suitable grasping device, such as the shotgun stick 20 (FIG. 1), a grappler tool, one or more handling tools, etc. The first coupling ring 80 and the second coupling ring 82 may also define one or more rounded corners 85 to facilitate the grasping of the first coupling ring 80 and the second coupling ring 82.

With reference to FIG. 4, the third coupling ring 84 extends outwardly from the base 70 along an axis A4. The third coupling ring 84 generally extends outwardly from the base 70 along the axis A4 so as to be transverse to the longitudinal axis L. In one example, the third coupling ring 84 includes a tapered extension 84*a* and a coupling base 84*b*. The tapered extension 84*a* couples the third coupling ring 84 to the base 70 at an angle, and the coupling base 84*b* forms or defines a coupling bore 88. The coupling base 84*b* may also include one or more rounded corners 87 to facilitate the grasping of the third coupling ring 84.

The coupling bore 88 is generally defined so as to extend beyond the sixth end 78 of the base 70, and in one example, the coupling bore 88 extends beyond an end of the rope retaining portion 74 such that the coupling base 84*b* with the coupling bore 88 defines a distalmost end 90 of the shake-proof hook 10. The coupling bore 88 is substantially D-shaped; however, the coupling bore 88 may have any desired shape, such as rectangular, square, circular, oval, etc. The coupling bore 88 is sized to couple the shake-proof hook 10 to a suitable grasping device, such as the shotgun stick 20 (FIG. 1), a grappler tool, one or more handling tools, etc. In one example, the coupling bore 88 is substantially the same size as the coupling bores 86, however, one or more of the coupling bores 86, 88 may have a different size (e.g. smaller area, larger area) to facilitate the grasping of the shake-proof hook 10.

With reference to FIG. 4, the rope retaining portion 74 extends outwardly from the base 70 along an axis A5. Generally, the rope retaining portion 74 extends outwardly from the base 70 along the axis A5 so as to be substantially transverse to the base 70. In one example, the rope retaining portion 74 extends outwardly from the base 70 along the axis A5 so as to be substantially perpendicular to the longitudinal axis L. The rope retaining portion 74 includes a body 92 and a rope receiver 94.

In one example, the body 92 includes a seventh end 96 and an eighth end 98. The seventh end 96 is coupled to the first arm 34. The seventh end 96 includes a first sidewall portion 100, which may be coupled to the sidewall 46. The first sidewall portion 100 is substantially perpendicular to the base 70, and may extend at an angle relative to the base 70 such that an angle $\alpha$ is defined between the first sidewall portion 100 and the sidewall 46. A curved sidewall portion 102 interconnects the first sidewall portion 100 and the seventh end 96. The curved sidewall portion 102 includes a concave portion 102*a* coupled to a convex portion 102*b*. The concave portion 102*a* provides a relief to enable a material reduction in the shake-proof hook 10 for weight savings. The convex portion 102*b* substantially surrounds the rope receiver 94 to provide a tying surface for a rope (such as that used with the rig 22 of FIG. 2). The convex portion 102*b* couples the curved sidewall portion 102 to the base 70. The first sidewall portion 100 and the curved sidewall portion 102 cooperate to define a channel 104. The channel 104 is in communication with the channel 44 to provide a uniform channel over the sides 10*a*, 10*b* of the shake-proof hook 10.

The rope receiver 94 extends outwardly from the channel 104. The rope receiver 94 is generally cylindrical, and forms or defines a bore 106. The bore 106 extends along an axis transverse to the longitudinal axis L. The bore 106 has a diameter that is sized to receive a rope, such as the rope used with the rig 22 of FIG. 2. The rope receiver 94 generally extends outwardly from the channel 104 such that an uppermost surface 94*a* of the rope receiver 94 is planar with the convex portion 102*b* to provide a uniform surface for the rope.

With reference to FIGS. 1, 2 and 4, in order to use the shake-proof hook 10 to move the fuse 12 between the first position and the second position, with the shake-proof hook 10 formed, and a suitable grasping device, such as the shotgun stick 20, is coupled to one of the first coupling ring 80, the second coupling ring 82 and the third coupling ring 84. With the shake-proof hook 10 coupled to the shotgun stick 20, a suitable rope may be passed through the bore 106 and tied about the convex portion 102*b* to secure the rope to the rope receiver 94. The operator may then manipulate the shotgun stick 20 to couple the shake-proof hook 10 to the ring 16 of the fuse 12. For example, the lead-in portion 56*a* may be advanced into the opening 18 of the ring 16 such a portion of the ring 16 is received within the receptacle 58. The shake-proof hook 10 may be advanced through the opening 18 of the ring 16 until the ring 16 passes over the walls 68 and is seated in the sidewall channel 66. With the ring 16 seated in the sidewall channel 66, the operator may release the shake-proof hook 10 from the shotgun stick 20. The rope may be threaded through the rig 22, and the rig 22 may be used to apply a force to the shake-proof hook 10 to pull the fuse 12 from the first position (FIG. 1) to the second position (FIG. 2). As the ring 16 is seated within the sidewall channel 66, the ring 16 remains securely coupled to the shake-proof hook 10 throughout the movement of the fuse 12, including any unintended movement of the fuse 12. Thus, the shake-proof hook 10 ensures a controlled movement of the fuse 12 between the first position and the second position.

Figure 7:
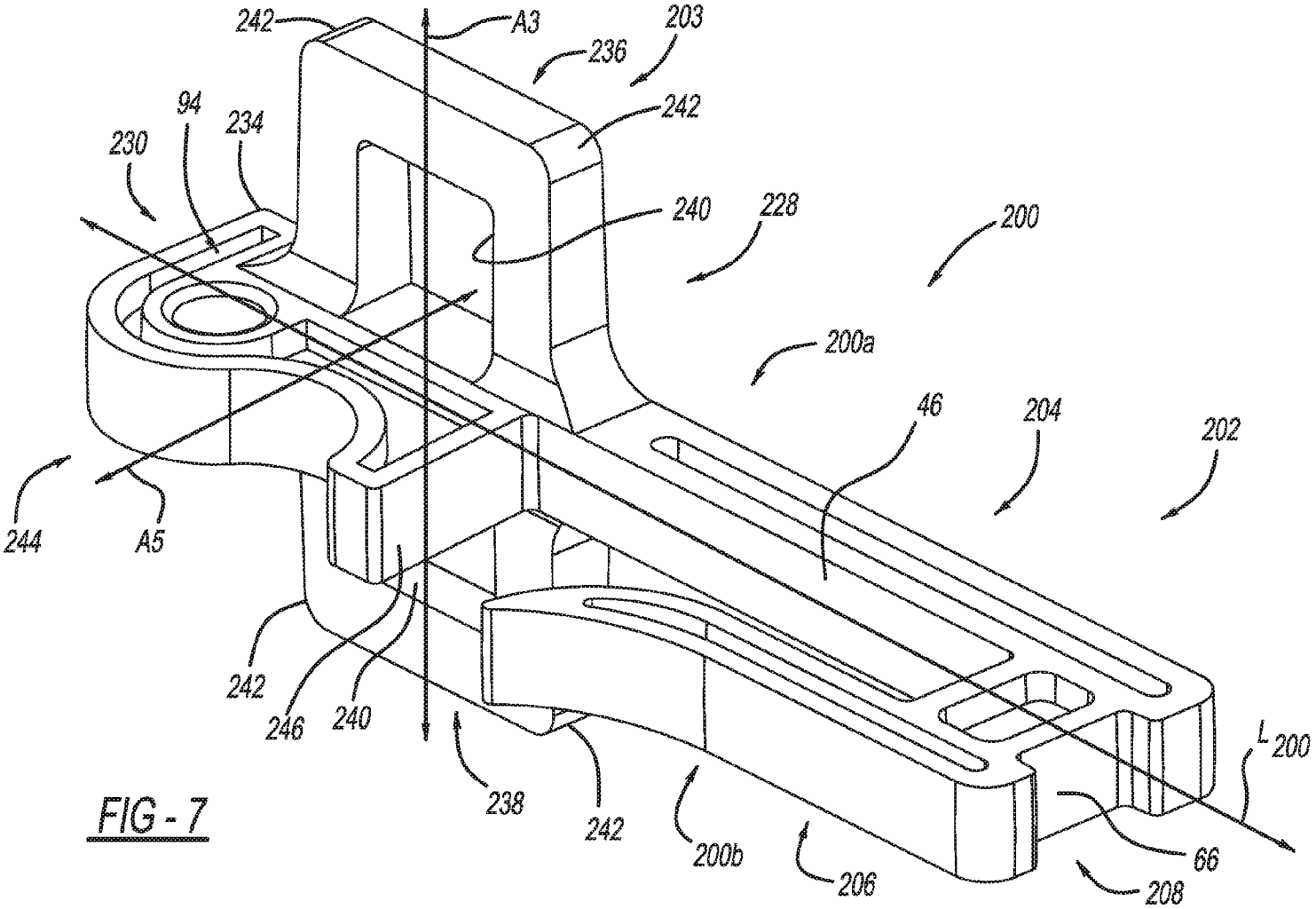
FIG. 7 is a front perspective illustration of a shake-proof hook for use with the fuse of the power distribution system of FIG. 1 in accordance with the present disclosure.

With reference now to FIG. 7, a shake-proof hook 200 is shown. As the shake-proof hook 200 can be similar to the shake-proof hook 10 discussed with regard to FIGS. 1-6, the same reference numerals used to denote the same or substantially similar components. The shake-proof hook 200 can be coupled to the ring 16 of the fuse 12 to assist in moving the fuse 12 between the first position and the second position (FIGS. 1 and 2).

With reference to FIG. 7, in one example, the shake-proof hook 200 is a monolithic or one-piece component, which is composed of an electrical insulating material, such as a polymer. In one example, the shake-proof hook 200 comprises an RTP 301 polycarbonate with glass fiber, available from RTP Company of Winona, Minn. USA. In this example, the glass fiber may comprise about 10 percent. It should be noted, however, that the shake-proof hook 200 may be composed of any suitable insulating material, and the use of a polycarbonate is merely an example. Moreover, the shake-proof hook 200 may be composed of a suitable insulating material that has a sufficient strength to enable the shake-proof hook 200 to hold a desired amount of weight. In this example, the shake-proof hook 200 may hold up to about 300 pounds (lb.). The shake-proof hook 200 may be formed through any suitable manufacturing technique, such as injection molding, etc. In this example, the shake-proof hook 200 is substantially symmetric with respect to a longitudinal axis L200 of the shake-proof hook 200 such that a first side 200*a* of the shake-proof hook 200 is a mirror image of a second side 200*b* of the shake-proof hook 200. It should be understood, however, that one or more portions of the shake-proof hook 200 may be offset or asymmetrical relative to the longitudinal axis L200. Generally, the shake-proof hook 200 includes a first, hook end or portion 202 and a second, coupling end or portion 203.

The hook portion 202 couples the shake-proof hook 200 to the ring 16 of the fuse 12 (FIGS. 1 and 2). In one example, the hook portion 202 is substantially U-shaped, however, the hook portion 202 may have any desired shape. In this example, the hook portion 202 includes a first arm 204, a second arm 206 and a branch 208, which interconnects the first arm 204 and the second arm 206.

Figure 8:
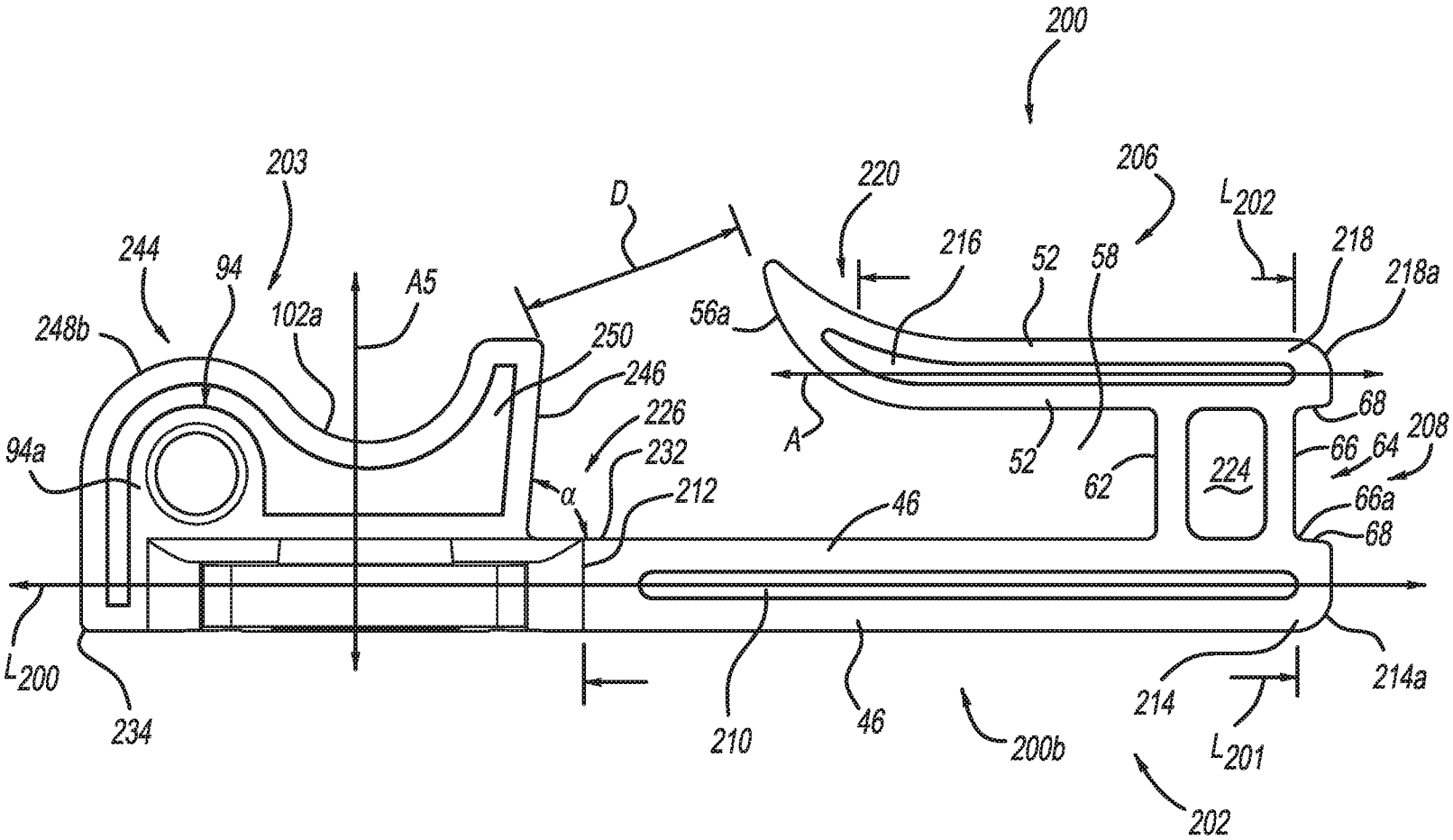
FIG. 8 is a side view of the shake-proof hook of FIG. 7.

The first arm 204 couples the hook portion 202 to the coupling portion 203. With reference to FIG. 8, the first arm 204 extends along the longitudinal axis L200 of the shake-proof hook 200. It should be noted that FIG. 8 illustrates the side 200*b* of the shake-proof hook 200. As the shake-proof hook 200 is substantially symmetric with respect to the longitudinal axis L200, it will be understood that the side 200*a* of the shake-proof hook 200, which is opposite the side illustrated in FIG. 8, is a mirror image of the side 200*b* illustrated in FIG. 8. Thus, it will be understood that the following description of the side 200*b* illustrated in FIG. 8 is applicable to the side 200*a* of the shake-proof hook 200.

The first arm 204 has a length L201, which is greater than a length L202 of the second arm 206. The length L201 of the first arm 204 is generally sized to provide a voltage isolation length between the branch 208 and the coupling portion 203. The first arm 204 may also define a channel 210 between opposing sidewalls 46; however, it will be understood that the first arm 204 may have a planar surface, if desired. The first arm 204 includes a first end 212 and a second end 214. The first end 212 is coupled to the coupling portion 203, and the second end 214 is coupled to the branch 208. In one example, the second end 214 includes a radius 214*a*. The radius 214*a* provides a transition for coupling the second end 214 to the branch 208.

With continued reference to FIG. 8, the second arm 206 is spaced apart from the first arm 204 via the branch 208. The second arm 206 is cantilevered relative to the branch 208 to enable the shake-proof hook 200 to be coupled to the fuse 12. Generally, the second arm 206 passes through the opening 18 of the ring 16 to couple the shake-proof hook 200 to the fuse 12 (FIGS. 1 and 2). In this example, the second arm 206 generally extends along the axis A, which is offset from and substantially parallel to the longitudinal axis L200. The second arm 206 may define a channel 216 between opposing sidewalls 52; however, it will be understood that the second arm 206 may have a planar surface, if desired. The second arm 206 includes a third end 218 and a fourth end 220. The third end 218 is coupled to the branch 208. The third end 218 includes a radius 218*a*, which provides a transition for coupling to the branch 208. The fourth end 220 includes the lead-in portion 56*a* to assist in guiding the shake-proof hook 200 through the opening 18 of the ring 16 (FIGS. 1 and 2). The lead-in portion 56*a* is spaced apart from the coupling portion 32 by the distance D.

The branch 208 interconnects the first arm 204 and the second arm 206. Generally, the branch 208 interconnects the first arm 204 and the second arm 206 so as to define the receptacle 58 for the ring 16 of the fuse 12. The branch 38 may define a channel 224 between opposing sidewalls 62, 64. The sidewall 62 may be planar, while the opposing sidewall 64 may define the sidewall channel 66.

Figure 9:
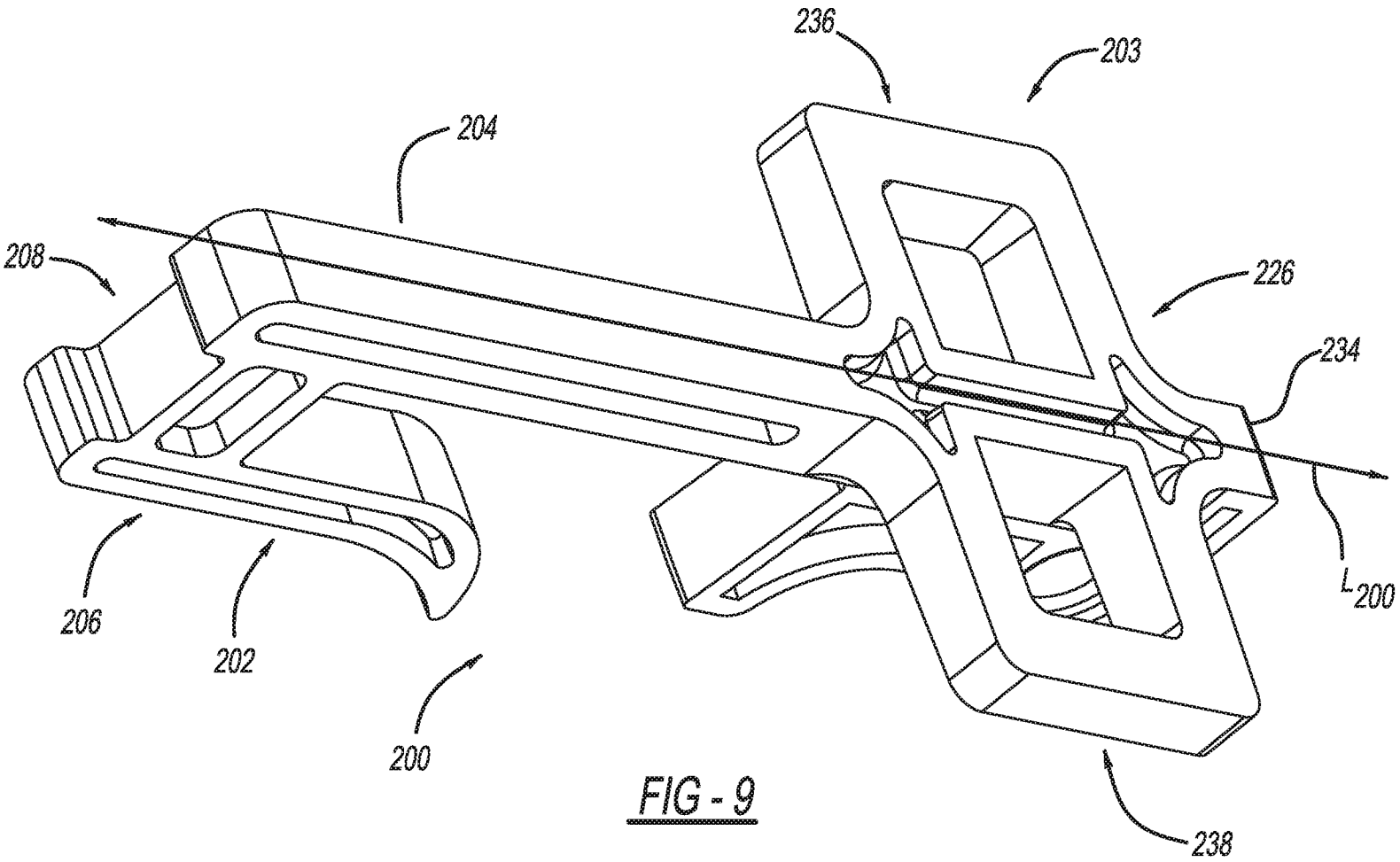
FIG. 9 is a rear perspective view of the shake-proof hook of FIG. 7.

The coupling portion 203 provides a grasping portion for manipulating the shake-proof hook 200 to couple the shake-proof hook 200 to the ring 16 of the fuse 12 (FIGS. 1 and 2). Generally, with additional to FIG. 9, the coupling portion 203 includes a base 226. One or more coupling rings 228 and a retaining portion or a rope retaining portion 230 extend outwardly from the base 226 (FIG. 7). The base 226 extends generally along the longitudinal axis L200. With reference to FIG. 8, the base 226 is substantially planar. The base 226 includes a fifth end 232 and a sixth end 234. The fifth end 232 is coupled to the first end 212 of the first arm 204, and the sixth end 234 is coupled to the rope retaining portion 230. In one example, with reference to FIG. 7, the coupling portion 203 includes a first coupling ring 236, a second coupling ring 238 and the rope retaining portion 230, which are each coupled to the base 226.

The first coupling ring 236 and the second coupling ring 238 each extend outwardly from opposite sides of the base 226 along the axis A3. Generally, the first coupling ring 236 and the second coupling ring 238 extend from the base 226 along the axis A3 so as to be transverse to the longitudinal axis L200. In one example, the first coupling ring 236 and the second coupling ring 238 extend outwardly from the base 226 along the axis A3 so as to be substantially perpendicular to the longitudinal axis L200. In this example, the first coupling ring 236 and the second coupling ring 238 each form or define a coupling bore 240. The coupling bores 240 are substantially rectangular; however, the coupling bores 240 may have any desired shape, such as D-shaped, square, circular, oval, etc. The coupling bores 240 are sized to couple the shake-proof hook 200 to a suitable grasping device, such as the shotgun stick 20 (FIG. 1), a grappler tool, one or more handling tools, etc. The first coupling ring 236 and the second coupling ring 238 may also define one or more rounded corners 242 to facilitate the grasping of the first coupling ring 236 and the second coupling ring 238.

The rope retaining portion 230 extends outwardly from the base 226 along the axis A5. Generally, the rope retaining portion 230 extends outwardly from the base 226 along the axis A5 so as to be substantially transverse to the base 226. In one example, the rope retaining portion 230 extends outwardly from the base 226 along the axis A5 so as to be substantially perpendicular to the longitudinal axis L200. The rope retaining portion 230 includes a body 244 and the rope receiver 94.

In one example, with reference to FIG. 8, the body 244 extends along the fifth end 232 and the sixth end 234 of the base 226. The body 244 includes a first sidewall portion 246, which may be coupled to the sidewall 46. The first sidewall portion 246 is substantially perpendicular to the base 226, and may extend at an angle relative to the base 226 such that the angle $\alpha$ is defined between the first sidewall portion 246 and the sidewall 46. A curved sidewall portion 248 interconnects the first sidewall portion 246 and the sixth end 234. The curved sidewall portion 248 includes the concave portion 102*a* coupled to a convex portion 248*b*. The convex portion 248*b* substantially surrounds the rope receiver 94 to provide a tying surface for a rope (such as that used with the rig 22 of FIG. 2). The convex portion 248*b* couples the curved sidewall portion 248 to the sixth end 234. The first sidewall portion 246 and the curved sidewall portion 248 cooperate to define a channel 250.

As the use of the shake-proof hook 200 is substantially similar to the use of the shake-proof hook 10, the use of the shake-proof hook 200 will not be described in detail herein as one of skill in the art would understand how to use the shake-proof hook 200 to move the fuse 12 between the first position and the second position, as discussed with regard to the shake-proof hook 10 of FIGS. 1-6.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A shake-proof hook comprising:

a hook end that defines a receptacle, the hook end including a lead-in portion and a channel spaced apart from the lead-in portion; and a coupling end coupled to the hook end, the coupling end including a base coupled to the hook end, a retaining portion and at least one coupling ring, the base having a plurality of sides, the retaining portion extending upwardly from a first side of the plurality of sides of the base along a first axis transverse to a longitudinal axis of the shake-proof hook, the retaining portion including a body having a sidewall that is spaced a distance apart from the lead-in portion to define an opening into the receptacle and defining a bore spaced apart from the sidewall, the at least one coupling ring extending outwardly from a second side of the plurality of sides of the base, and the at least one coupling ring extending along a second axis, the second axis transverse to the longitudinal axis and the second axis different than the first axis.

2. The shake-proof hook of claim 1, wherein the at least one coupling ring comprises a first coupling ring extending outwardly from the second side of the plurality of sides of the base and a second coupling ring extending outwardly from a third side of the plurality of sides of the base along the second axis, the second side opposite the third side and the first side interconnects the second side and the third side.

3. The shake-proof hook of claim 2, wherein the at least one coupling ring further comprises a third coupling ring, and the third coupling ring extends outwardly from the base at an angle and along a third axis, the third axis transverse to the longitudinal axis.

4. The shake-proof hook of claim 3, wherein the third axis is different from the first axis and the second axis.

5. The shake-proof hook of claim 1, wherein the hook end includes a first arm coupled to the coupling end and a second arm spaced apart from and coupled to the first arm via a branch, and the branch defines the channel.

6. The shake-proof hook of claim 5, wherein the second arm includes the lead-in portion.

7. The shake-proof hook of claim 1, wherein the bore extends along a fourth axis that is transverse to the longitudinal axis.

8. The shake-proof hook of claim 1, wherein the shake-proof hook is substantially symmetrical about the longitudinal axis.

9. The shake-proof hook of claim 1, wherein the first axis is substantially perpendicular to the longitudinal axis and is substantially perpendicular to the second axis.

10. The shake-proof hook of claim 1, wherein the shake-proof hook is monolithic.

11. A shake-proof hook comprising:

a hook end that defines a receptacle, the hook end including a first arm spaced apart from a second arm via a branch, and the branch defines a channel to receive a portion of a fuse; and a coupling end coupled to the hook end by the first arm, the coupling end including a retaining portion, a first coupling ring and a second coupling ring extending outwardly from a base, each of the first coupling ring and the second coupling ring defining a coupling bore having a coupling bore axis that extends perpendicular to a longitudinal axis of the shake-proof hook, the retaining portion extending along a first axis transverse to a longitudinal axis of the shake-proof hook and parallel to the coupling bore axis, the retaining portion including a body having a sidewall that is spaced a distance apart from the second arm to define an opening into the receptacle, the first coupling ring and the second coupling ring extending along a second axis, the second axis transverse to the longitudinal axis and the second axis different than the first axis and the retaining portion defines a bore that extends along a bore axis, the bore spaced apart from the sidewall, the bore axis transverse to the longitudinal axis and perpendicular to the coupling bore axis.

12. The shake-proof hook of claim 11, wherein the base has a plurality of sides, the body of the retaining portion extends upward from a first side of the plurality of sides, the first coupling ring extends outwardly from the second side of the plurality of sides and the second coupling ring extends outwardly from a third side of the plurality of sides along the second axis, the second side opposite the third side and the first side interconnects the second side and the third side.

13. The shake-proof hook of claim 12, wherein the coupling end further comprises a third coupling ring, and the third coupling ring extends outwardly from a fourth side of the plurality of sides of the base at an angle and along a third axis, the third axis transverse to the longitudinal axis and different from the first axis and the second axis.

14. The shake-proof hook of claim 11, the second arm includes a lead-in portion and the lead-in portion is spaced apart from the sidewall of the retaining portion by the distance.

15. The shake-proof hook of claim 11, wherein the shake-proof hook is substantially symmetrical about the longitudinal axis.

16. The shake-proof hook of claim 11, wherein the first axis is substantially perpendicular to the longitudinal axis and is substantially perpendicular to the second axis.

17. The shake-proof hook of claim 11, wherein the shake-proof hook is monolithic.

18. A shake-proof hook comprising:

a hook end that defines a receptacle, the hook end including a first arm spaced apart from a second arm via a branch, and the branch defines a channel to receive a portion of a fuse; and a coupling end coupled to the hook end by the first arm, the coupling end including a retaining portion, a first coupling ring, a second coupling ring and a third coupling ring extending outwardly from a base, the retaining portion extending along a first axis transverse to a longitudinal axis of the shake-proof hook and the retaining portion including a body having a sidewall that is spaced apart from the second arm by a distance to define an opening into the receptacle, the retaining portion defining a bore that is spaced apart from the sidewall, the first coupling ring and the second coupling ring extending outwardly from opposite sides of the base along a second axis, the second axis substantially perpendicular to the longitudinal axis and the second axis different than the first axis, the third coupling ring having a coupling bore defined through a coupling base, the coupling base extends outwardly from the base at an angle and along a third axis, the third axis transverse to the longitudinal axis and different from the first axis and the second axis, the coupling base with the coupling bore extends beyond an end of the base and defines a distalmost end of the shake-proof hook.

* * * * *